United States Patent [19]

Leong et al.

[11] Patent Number: 4,603,315

[45] Date of Patent: Jul. 29, 1986

[54] ELECTRICAL FUSE WITH PYROTECHNIC BLOWOUT INDICATOR

[75] Inventors: Berry Leong, Buffalo Grove; David Krueger, Arlington Heights, both of Ill.

[73] Assignee: Littelfuse, Inc., DesPlaines, Ill.

[21] Appl. No.: 652,082

[22] Filed: Sep. 20, 1984

[51] Int. Cl.[4] ..... H01H 85/30

[52] U.S. Cl. ..... 337/243; 337/265

[58] Field of Search ..... 337/243, 241, 265, 30; 116/206, 207, 214; 422/86

[56] References Cited

U.S. PATENT DOCUMENTS 1,033,754 7/1912 Buchanan ..... 337/243

2,007,313 7/1935 Sherwood ..... 337/243

*Primary Examiner*—Harold Broome

*Attorney, Agent, or Firm*—Russell E. Hattis; Stephen R. Arnold

[57] ABSTRACT

An electrical fuse features a pyrotechnic smoke-generating mixture supported proximate to or adheringly supported on a meltable fuse wire element. A portion of the fuse housing is transparent. Upon either low current or high current blowout the local temperatures attendant thereto cause ignition of the pyrotechnic mixture and evolution of a cloud of colored smoke which deposits on the interior of the transparent portion of the housing to yield a readily visible indication that the fuse has blown. Additionally, when the fuse is operated at temperatures close to blowout conditions, a different colored smoke is produced to indicate incipient fuse deterioration.

31 Claims, 6 Drawing Figures

ELECTRICAL FUSE WITH PYROTECHNIC BLOWOUT INDICATOR

TECHNICAL FIELD OF THE INVENTION

The technical field of the invention is the electrical circuit protection art, in particular circuit protection units employing meltable fuse elements.

BACKGROUND OF THE INVENTION

There is a need in the electrical fuse art for a reliable, inexpensive, readily visible indication that a fuse has blown. It is commonly known, even in the case of a conventional cylindrical fuse having a transparent glass cylindrical sleeve which allows visual inspection of the fuse element, that it is often difficult to tell visually whether the fuse has blown or not. Particularly in the case of low current fuses using very fine fuse wires, such visual inspection frequently requires that the fuse be removed and carefully examined visually. Not only is such inspection time consuming, but it is frequently impossible to carry out under adverse lighting conditions. To the applicant's knowledge, prior to the present invention, no satisfactory low cost solution to this problem has been found. For example, while various mechanical flags have been proposed which spring into view when the fuse blows, the cost of providing such flags makes them impractical.

SUMMARY OF THE INVENTION

According to the broadest aspect of the invention, there is exposed to the fuse element material within a fuse housing a quantity of fuse appearance-modifying material capable of undergoing a chemical reaction to cause a permanent visible change in the appearance of the fuse, the material including means for producing such chemical reaction when the temperature conditions within the fuse housing indicate that the fuse has or should be blown. Fast, medium, and slow blow fuses should blow under sudden massive short-circuit load conditions. According to a more specific preferred aspect of the invention, and in the exemplary form thereof, the fuse appearance modifying material takes the form of a combustible pyrotechnic mixture sufficiently proximate to the hottest-running portion of the fuse wire so that upon fuse blowout the normal heating and/or arcing attendant thereto, even under modest current overload conditions, is sufficient to ignite the mixture. In the preferred form of the invention the pyrotechnic mixture has incorporated therein an igniter which ignites under relatively modest overload blowing conditions, and a combustible component which is ignited and undergoes combustion to evolve a colored smoke, which then deposits on the inner surface of the walls of the housing, which here are transparent. This results in a permanent indication of a blown fuse that is readily visible, even under adverse lighting conditions.

According to a more specific aspect of the invention, a U-shaped fuse wire is employed having its central arcuate end extending free of but still close to a self-curing potting compound, preferably having arc-quenching properties to prevent the fuse blowout arc from propagating to the fuse wire support terminals. In this structure the pyrotechnic mixture is prepared in powder form. A limited quantity of glue is preferably applied to cause the powder to adhere not only to the surface of the potting compound, but also, and most preferably to all of, the extending fusewire.

In accordance with the broadest aspects of the invention, less desirable materials than the pyrotechnic material described may be utilized as a means for indicating a blown fuse condition. Thus, chemical mixtures may be employed which respond directly to the fuse blowing conditions without the need for a separate igniting component to provide a smoke or other color-producing reaction component; however, smoke-generating mixtures are preferred because in general the smoke will disseminate throughout the housing, and the use of a housing having a generally large transparent region thereon will exhibit at a single glance the condition of the fuse.

The above and other features of the invention will become apparent upon making reference to the specification to follow, the claims, and the drawings.

DETAILED DESCRIPTION OF THE INVENTION

Figure 1:
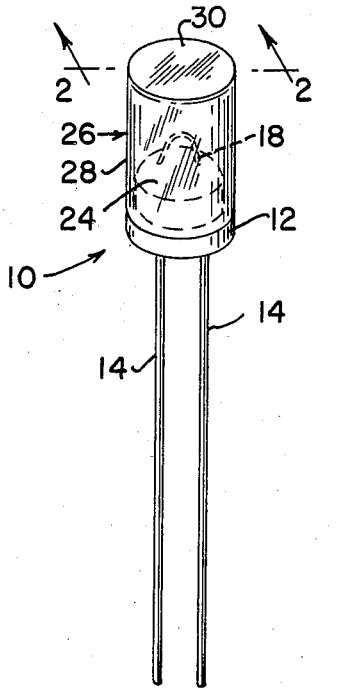
FIG. 1 is perspective view of the fuse of the present invention, showing an arcuate length of fuse wire extending from a potting matrix and contained within a transparent cylindrical housing.

FIGS. 1–5*b* show various views of an indicating fuse 10 embodying the principles of the present invention. The structure shown is particularly applicable to fuses of very low amperage rating; however, modifications appropriate to high amperage fuse elements will be readily apparent to those knowledgeable in the art. A cylindrical insulating base 12 has a pair of parallel terminal leads 14 passing therethrough and having interior end portions 16 supported on bosses 17 and attached by solder means 22 to ends of a U-shaped inwardly extending fuse wire 18. A transparent housing 26 consists of a cylindrical transparent wall-forming sleeve 28 sealingly affixed to the cylindrical base 12 at one end, and having an integral transparent circular end cap 30 at the other end.

With the assembly held in an upright position so that the innermost end 20 of the fuse wire is pointing upward a small drop of suitable self-curing potting compound, preferably having known arc-quenching properties, such as epoxy plastic or alternatively self-vulcanizing silicone, is placed on the upper surface of the base 12 to reach a level where it completely encapsulates the interior portions 16 of the terminal leads 14, as well as lower portions of the fuse wire 18, leaving the upper central arcuate portion 20 of the fuse wire exposed above the surface thereof.

After the potting compound 24 has hardened, a thin layer of glue is applied to the surface thereof, and the structure is inverted and dipped into a quantity of pyrotechnic mixture in powder form. It is customarily observed upon withdrawal of the structure from the powder that not only the surface of the potting compound 24, but also that most, if not all of the unsupported region 20 of the fuse wire 18 is adhesively coated with powder mixture. Whether this arises from migration of the glue along the fuse wire or by a local capillary action of some form within the powder is not known; however, in practice at least a substantial portion of the unsupported region 20 is effectively coated by this means. The structure may be thereafter lightly vibrated to remove non-bonded traces of pyrotechnic mixture 32. Upon curing, the glue thus adhesively secures the pyrotechnic mixture 32 in place. The housing 26 is next sealingly secured in place to the base by conventional means.

As the current through the fuse wire 18 is raised, at some current value melting will occur in the innermost portion 20 of the fuse wire, with the result that a local arc will develop, igniting the combustible mixture 32. In the exemplary form of the invention ignition of the mixture 32 causes generation of a cloud of smoke, preferably colored, the reaction continuing until all combustible material has been consumed. An adequate quantity of smoke 34 is generated to deposit upon the interior surfaces of the housing 26. Such a colored smoke forms a permanent residue on the interior of the housing 26, and represents a permanent readily visible indication to the observer that burnout has occured.

A great variety of pyrotechnic mixtures may be employed; however, the preferred form just described is a two component system consisting of an igniter mixture and a combustible smoke producing mixture. The purpose of the igniter mixture is to initiate the combustion process at a reasonably well-defined temperature, this mixture in turn igniting the combustible smoke-producing mixture, which requires a somewhat higher ignition temperature. This smoke-producing mixture then undergoes combustion to provide the requisite smoke. Because it is desirable to produce a substantial quantity of smoke, and because the quantity of atmospheric oxygen available within the housing 26 is limited, it is preferred that both mixtures be self-sufficient, i.e. that they contain their own oxidizing agents.

Figure 2:
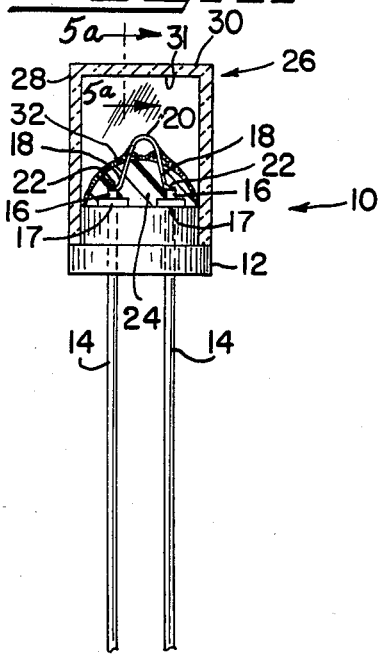
FIG. 2 is a cross-section front elevational view of the fuse shown in FIG. 1, and further showing a layer of pyrotechnic mixture deposited over the surface of the potting matrix and the fuse wire.
Figure 3:
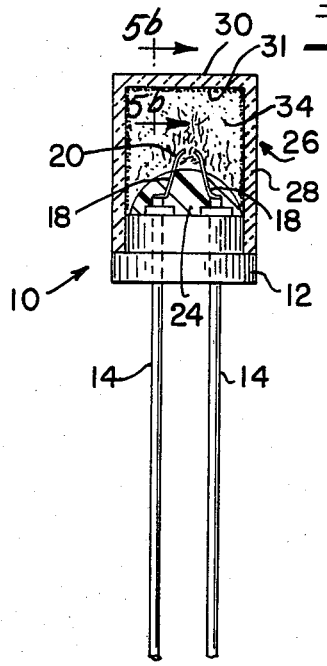
FIG. 3 is a similar view of the fuse as shown in FIG. 2, here showing the fuse blowout process wherein the pyrotechnic mixture has been ignited to evolve smoke to deposit on the interior walls of the transparent housing.
Figure 4:
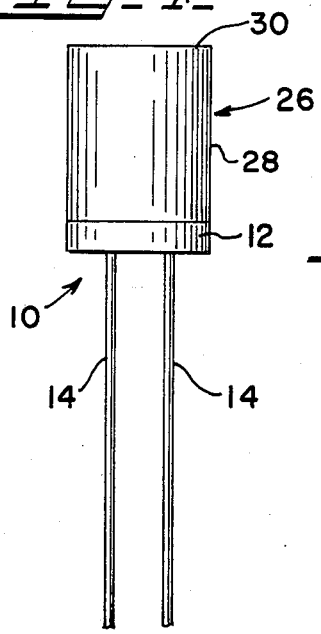
FIG. 4 is a front elevational view of the fuse of FIG. 3 after blowout, and showing that the housing is no longer transparent as in FIG. 1 because of the presence of smoke deposits on the inside of the housing.
Figure 5A:
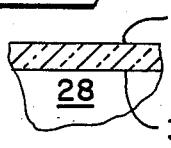
FIG. 5*a* is a fragmentary cross-sectional view along the direction indicated in FIG. 2 showing the outer and inner surfaces of the transparent fuse housing cap and a portion of the outer wall.
Figure 5B:
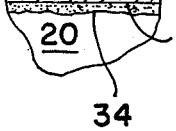
FIG. 5*b* shows the same region as FIG. 5*a* after fuse blowout, showing a layer of deposited smoke coating the interior upper surface of the fuse housing cap.

With particular reference to the fuse structure 10 shown in FIGS. 1 and 2, the igniter mixture was made from the heads of commercially available safety matches. The head material was simply crushed away from the matchstick and reduced by grinding to a granular consistency of from about 0.004 to about 0.032 inches. Such compositions are typically mixtures of potassium chlorate, potassium dichlorate, manganese dioxide, sulphur, iron oxide, red phosphorus, and antimony sulfide, these substances being mixed together in powder form and held together by a trace of glue binder. It will be immediately evident to those of ordinary skill in the chemical arts that a great variety of other igniter mixtures may equally well be employed. The smoke generating mixture was procured from a pyrotechnic green-smoke bomb, the combustible material being similarly pulverized to a similar granular consistency. The composition of this mixture is known to be five parts potassium chlorate, five parts lactose, three parts auramine, and five parts indigo (all parts by weight). The mixture ratio most successfully employed thus far is in the ratio 7 parts by weight of igniter powder, one part by weight of smoke generating mixture, and 0.5 parts by weight of indigo. Using a fuse wire 18 of 45 per-cent nickel and 55 per-cent copper and having an outer end 20 extending one millimeter above the surface of the pyrotechnic mixture 32, the fuse having a one ampere current rating, ignition of the pyrotechnic compound 32 is achieved under moderate blowout conditions at 1.50 amperes. A blue-black or green-black smoke deposit results, and is readily visible. These tests were run on fuse structures having a roughly hemispherical bead of potting compound 24 as shown in FIG. 2, with approximately 120 milligrams of powder mixture 32 applied thereto. As one would expect, ignition also occurs on massive high current blowout as well.

Thus, by adding a measured quanitity of a suitable smoke-generating pyrotechnic compound appropriately located with respect to a fuse wire, an inexpensive solution has been found to a hitherto unsolved problem, namely being able to tell at a glance the condition of a low-current fuse. As to higher amperage fuses, similar considerations apply, and irrespective of the amperage of fuse to which the present invention is applied, even the totally inexperienced can immediately detect which fuse of a given array is in a blown condition. No detailed knowledge of the interior structure of the fuse is necessary; the inexperienced individual need merely be told to look for a given change in color, and nothing more.

A principal objective of the invention is to give an indication when the fuse has been blown, that is, when the fuse wire has actually deteriorated to a point where it interrupts the circuit. Another useful aspect of the present invention is achieved by employing a composition which also indicates when the fuse has been operated at current levels detrimental to the desired life of the fuse, even though not actually causing the fuse filament to melt and interrupt the circuit. If a fuse is repeatedly operated near its rated value, i.e. at slight overload conditions which will not cause the fuse filament to blow, this condition actually deteriorates the life of the fuse; hence, it is generally recommended that a fuse which is rated at a given current level actually be placed in a circuit where the normal load currents are no greater than about 80% of that value.

It has been found that apparently some of the materials in the composition described are sensitive to elevated temperature conditions of the fuse filament which are insufficient to result in the blowing of that fuse filament but which indicate that the fuse is operated under conditions which can degrade the fuse. These materials produce a different color indication on the walls of the housing, possibly by causing a reaction involving some but not all of the components of the pyrotechnic mixture which react when the fuse blows. For example, it was observed that when a fuse using the pyrotechnic mixture previously described was operated under current conditions of about 72 percent of its rated value for 23 hours, at least some of the material exposed to the hottest portion of the fuse filament apparently underwent a chemical reaction which generated a yellow smoke which appeared on the housing walls. When such a fuse was operated under current conditions of 85 to 90 percent of its rated value, a reddish colored smoke deposited on the housing wall. These conditions would indicate to the user that, while the fuse has not actually blown, it has been operated close to its recommended application value, which could adversely affect the expected life of the fuse. As previously mentioned, when the same fuse blew, the color of the smoke was of a bluish-black or greenish-black color, which would indicate to the observer that the fuse was blown, rather than merely abused.

Finally, although in the preferred form of the invention the pyrotechnic mixture was adhered to both the free portion 20 of the fuse wire 18 as well as to the surface of the potting compound 24, results similar to the foregoing have been achieved by placing the pyrotechnic mixture on the surface of the potting compound only, and contacting the fuse wire 18 only at the points of emergence therefrom. Although the quantity of smoke evolved was somewhat reduced, such an approach may be preferable in certain situations where for one reason or another absolutely no additional thermal mass of any sort may be tolerated at the hottest-running portions of the fuse wire.

It will be evident to those of ordinary skill in the art that the principles of the present invention are by no means restricted to the particular geometry of fuse elements shown in the appended drawings, but that pyrotechnic mixtures proximate to or physically supported upon chosen portions of a fuse element of any given geometry may be used to similar advantage.

While the invention has been described with reference to a preferred embodiment, it will be understood by those skilled in the art that various changes may be made and equivalents may be substituted for elements thereof without departing from the broader aspects of the invention. Therefore, it is intended that the broad aspects of the invention not be limited to a particular embodiment disclosed as the best mode contemplated for carrying out the invention, while various specific exemplary details of the invention constitute important specific aspects of the invention.

Thus, for example, as previously indicated, the broadest aspect of the invention envisions the use of materials (other than the fuse material) in the fuse housing which in various ways can chemically react under fuse blowing conditions to produce a change in the appearance of the fuse even under prolonged overload blowing conditions. In the preferred form of the invention, there are two different types of materials within the fuse housing for producing this change in appearance. One of these materials is directly responsive to fuse blowing conditions to create a reaction-initiating condition, such as an igniting condition, which, in turn, creates a chemical reaction in another material which produces the change of appearance within the fuse. The initiating material could produce a gas rather than an igniting condition in response to the fuse blowing conditions, which gas in turn would produce a chemical reaction in another material to produce a visible change in appearance. A still further variant of the broadest aspect of the invention could less desirably be a material which does not require an initiator to effect its reaction, but rather directly reacts to the fuse blowing conditions and changes the appearance of the fuse. (For example, such a material could be black gunpowder.) Also, instead of the ultimate reacting material producing a smoke, it could be a material which remains in place and has its appearance changed by the initiating material or which alternatively directly responds to the blowing conditions of the fuse.

Furthermore, it should be recognized that the use of such ignitable exothermic substances may be used to contribute materially to fuse blowout control by proper selection of materials having a precisely defined ignition temperature properly chosen with respect to the thermal properties of the fuse element at a chosen blowout current rating. In such a system exothermic ignition would occur before the fuse element is at its melting point, ignition raising the fuse element temperature to cause it to open.

We claim:

1. In an electrical fuse having a given current value rating, said fuse including a housing, a meltable fuse element material disposed within said housing and extending between terminal electrode means, said fuse element blowing to interrupt the circuit under either prolonged overload current conditions above said rated value or under short-circuit conditions, and subject to irreversible deterioration when operated for a prolonged period of time slightly below the melting temperature of said element, the improvement comprising:

at least one housing appearance modifying material exposed to the fuse element material within said housing and made of a composition other than said fuse element material, said appearance modifying material undergoing a chemical reaction in response to temperature conditions produced by currents close to but less than said rated value, to cause a permanent visible change in the appearance of such fuse, said appearance modifying material including means for producing said chemical reaction in response to said temperature conditions to provide a visible indication that the fuse element may be deteriorating even though the fuse has not been blown.

2. The electrical fuse of claim 1 wherein said appearance modifying material also includes at least one component which undergoes a chemical reaction in response to fuse blowing conditions to cause a permanent visible change in the appearance of said fuse different from that caused by said current conditions less than said rated value, said appearance modifying material including means for producing said different chemical reaction, to provide a visibly distinguishable difference between a fuse which may have deteriorated but not blown and a fuse which has been blown.

3. The fuse of claim 2 wherein said means for producing said chemical reaction includes an ignitable material actuatable to a state of combustion by the blowing of said fuse element.

4. The fuse of claims 2 or 3 wherein at least a portion of said housing is transparent and said material includes one or more chemical components for generating a quantity of colored smoke responsively to ignition of said ignitable material which smoke deposits on the walls of said transparent portion of the housing.

5. The fuse of claim 2 wherein at least a portion of said appearance modifying material is disposed proximate to the hottest-running portion of said fuse element.

6. The fuse of claim 2 wherein at least a portion of said appearance modifying material is exposed to but spaced from the hottest-running portion of said fuse element.

7. The fuse of claim 2 wherein said fuse further includes a quantity of solid arc-quenching means surrounding at least one end of said fuse element between a hottest-running portion thereof and one of said terminal attachment means, said appearance modifying material being adheringly supported by said arc-quenching means so as to be exposed to the arc propagating upon fuse blowout from said hottest-running portion to said arc-quenching means.

8. The fuse of claim 2 wherein said fuse further includes a quantity of solid arc-quenching means surrounding the ends of said fuse element between a hottest-running portion thereof and said terminal attachment means, said fuse element is configured as a generally outwardly projecting self-supporting filament having the ends thereof contactingly secured to said terminal electrode means, said arc-quenching means includes an insulating solid mass disposed to contactingly encapsulate at least the interior ends of said terminal electrode means and the end portions of the fuse element attached thereto, at least a portion of said appearance modifying material being adheringly supported on at least a portion of said fuse element external to said arc-quenching means and on the surface of said solid mass immediately proximate to the points of emergence of said fuse element therefrom, and the central apex portion of said element extends beyond said solid mass to be separated at a distance therefrom.

9. The fuse of claim 2 wherein said fuse element is configured as a generally outwardly projecting self-supporting filament having the ends thereof contactingly secured to said terminal electrode means and having a central apex portion thereof extending into the interior of said housing and away from said terminal electrode means, said fuse further including a quantity of solid arc-quenching means including an insulating solid mass disposed to contactingly encapsulate at least the interior ends of said terminal electrode means and the end portions of the fuse element attached thereto, said insulating solid mass completely covering the interior portions of said terminal electrode means and said end portions of said fuse element to present a single continuous surface confronting said central apex portion at a distance therefrom, the central apex portion of said element extending beyond said solid mass to be separated at a distance therefrom, said appearance modifying material is in powder form adheringly supported to said single continuous surface so as to be exposed to the arc propagating upon fuse blowout from said apex portion to said arc-quenching means, at least a portion of said appearance modifying material is adheringly supported on at least a portion of said fuse element external to said arc-quenching means and on the surface of said solid mass immediately proximate to the points of emergence of said fuse element therefrom, and said housing includes an insulating base through which said terminal electrode means extend as a parallel pair and a transparent cover sealingly affixed to said base portion.

10. The fuse of claim 3 wherein a portion of said housing is transparent and said appearance modifying material evolves smoke of substantially different appearance responsively to currents close to but less than said rated value and said fuse blowing conditions respectively.

11. The fuse of claim 2 wherein at least part of said appearance modifying material is ignitable and at least a portion of said appearance modifying material is disposed in operative contact with at least a portion of said fuse element.

12. The fuse of claim 2 wherein at least a portion of said material is disposed in contact with at least a portion of said fuse element, at least a portion of said housing is transparent and said appearance modifying material includes one or more chemical components for generating a quantity of colored smoke responsively to ignition of said appearance modifying material, which smoke deposits on the walls of said transparent portion of the housing.

13. The fuse of claim 2 wherein said fuse further includes a quantity of solid arc-quenching means surrounding the ends of said fuse element between a hottest-running portion thereof and said terminal attachment means, said fuse element is configured as a generally outwardly projecting self-supporting filament having the ends thereof contactingly secured to said terminal electrode means, said arc-quenching means includes an insulating solid mass disposed to contactingly encapsulate at least the interior ends of said terminal electrode means and the end portions of the fuse element attached thereto, at least a portion of said appearance modifying material being adheringly supported on at least a portion of said fuse element external to said arc-quenching means, and the central apex portion of said element extends beyond said solid mass to be separated at a distance therefrom.

14. The fuse of claim 2 wherein said fuse further includes a quantity of solid arc-quenching means surrounding the ends of said fuse element between a hottest-running portion thereof and said terminal attachment means, said fuse element is configured as a generally outwardly projecting self-supporting filament having the ends thereof contactingly secured to said terminal electrode means, said arc-quenching means includes an insulating solid mass disposed to contactingly encapsulate at least the interior ends of said terminal electrode means and the end portions of the fuse element attached thereto, at least a portion of said appearance modifying material being adheringly supported on the surface of said solid mass immediately proximate to the points of emergence of said fuse element therefrom, and the central apex portion of said element extends beyond said solid mass to be separated at a distance therefrom.

15. The fuse of claim 2 wherein said fuse element is configured as a generally outwardly projecting self-supporting filament having the ends thereof contactingly secured to said terminal electrode means and having a central apex portion thereof extending into the interior of said housing and away from said terminal electrode means, said fuse further including a quantity of solid arc-quenching means including an insulating solid mass disposed to contactingly encapsulate at least the interior ends of said terminal electrode means and the end portions of the fuse element attached thereto, said insulating solid mass completely covering the interior portions of said terminal electrode means and said end portions of said fuse element to present a single continuous surface confronting said central apex portion at a distance therefrom, the central apex portion of said element extending beyond said solid mass to be separated at a distance therefrom, said appearance modifying material is in powder form supported on at least a portion of said fuse element external to said arc-quenching means, and said housing includes an insulating base through which said terminal electrode means extend as a parallel pair and a transparent cover sealingly affixed to said base portion.

16. The fuse of claim 2 wherein said fuse element is configured as a generally outwardly projecting self-supporting filament having the ends thereof contactingly secured to said terminal electrode means and having a central apex portion thereof extending into the interior of said housing and away from said terminal electrode means, said fuse further including a quantity of solid arc-quenching means including an insulating solid mass disposed to contactingly encapsulate at least the interior ends of said terminal electrode means and the end portions of the fuse element attached thereto, said insulating solid mass completely covering the interior portions of said terminal electrode means and said end portions of said fuse element to present a single continuous surface confronting said central apex portion at a distance therefrom, the central apex portion of said element extending beyond said solid mass to be separated at a distance therefrom, said appearance modifying material is in powder form adheringly supported to said single continuous surface so as to be exposed to the arc propagating upon fuse blowout from said apex portion to said arc-quenching means, at least a portion of said appearance modifying material is adheringly supported on the surface of said solid mass immediately proximate to the points of emergence of said fuse element therefrom, and the central apex portion of said element extends beyond said solid mass to be separated at a distance therefrom.

17. In an electrical fuse including a housing including a transparent portion, a meltable fuse element material disposed within said housing and extending between terminal electrode means, the improvement comprising:

housing appearance modifying means exposed to the fuse element material within said housing and including a first material made of a composition other than said fuse element material, said first material undergoing a chemical reaction in response to a fuse blowout condition, and a second material which responds to said chemical reaction of said first material by the evolution of smoke which deposits on the walls of said transparent portion of the housing.

18. The fuse of claim 17 wherein said chemical reaction of said first material is a transition to an ignited combustion thereof.

19. The fuse of claim 17 wherein said appearance modifying means includes an ignitable material actuatable to a state of combustion by the blowing of said fuse element.

20. The fuse of claim 17 wherein at least a portion of said appearance modifying means is disposed proximate to the hottest-running portion of said fuse element.

21. The fuse of claim 17 wherein at least a portion of said appearance modifying means is exposed to but spaced from the hottest-running portion of said fuse element.

22. The fuse of claim 17 wherein said fuse further includes a quantity of solid arc-quenching means surrounding at least one end of said fuse element between a hottest-running portion thereof and one of said terminal attachment means, said appearance modifying means being adheringly supported by said arc-quenching means so as to be exposed to the arc propagating upon fuse blowout from said hottest-running portion to said arc-quenching means.

23. The fuse of claim 17 wherein said fuse further includes a quantity of solid arc-quenching means surrounding the ends of said fuse element between a hottest-running portion thereof and said terminal attachment means, said fuse element is configured as a generally outwardly projecting self-supporting filament having the ends thereof contactingly secured to said terminal electrode means, said arc-quenching means includes an insulating solid mass disposed to contactingly encapsulate at least the interior ends of said terminal electrode means and the end portions of the fuse element attached thereto, at least a portion of said appearance modifying means being adheringly supported on at least a portion of said fuse element external to said arc-quenching means and on the surface of said sold mass immediately proximate to the points of emergence of said fuse element therefrom, and the central apex portion of said elements extends beyond said solid mass to be separated at a distance therefrom.

24. The fuse of claim 17 wherein said fuse element is configured as a generally outwardly projecting self-supporting filament having the ends thereof contactingly secured to said terminal electrode means and having a central apex portion thereof extending into the interior of said housing and away from said terminal electrode means, said fuse further including a quantity of solid arc-quenching means including an insulating solid mass disposed to contactingly encapsulate at least the interior ends of said terminal electrode means and the end portions of the fuse element attached thereto, said insulating solid mass completely covering the interior portions of said terminal electrode means and said end portions of said fuse element to present a single continuous surface confronting said central apex portion at a distance therefrom, the central apex portion of said element extending beyond said solid mass to be separated at a distance therefrom, said appearance modifying means is in powder form adheringly supported to said single continuous surface so as to be exposed to the arc propagating upon fuse blowout from said apex portion to said arc-quenching means, at least a portion of said appearance modifying means is adheringly supported on at least a portion of said fuse element external to said arc-quenching means and on the surface of said solid mass immediately proximate to the points of emergence of said fuse element therefrom, and said housing includes an insulating base through which said terminal electrode means extend as a parallel pair and a transparent cover sealingly affixed to said base portion.

25. The fuse of claim 17 wherein said appearance modifying means evolves smoke of substantially different appearance responsively to currents close to but less than the rated value of said fuse and the fuse blowout current respectively.

26. The fuse of claim 17 wherein said appearance modifying means is ignitable and at least a portion of said appearance modifying means is disposed in operative contact with at least a portion of said fuse element.

27. The fuse of claim 27 wherein at least a portion of said appearance modifying means is disposed in contact with at least a portion of said fuse element, and said appearance modifying means includes one or more chemical components for generating a quantity of colored smoke responsively to ignition of said appearance modifying means, which smoke deposits on the walls of said transparent portion of the housing.

28. The fuse of claim 17 wherein said fuse further includes a quantity of solid arc-quenching means surrounding the ends of said fuse element between a hottest-running portion thereof and said terminal attachment means, said fuse element is configured as a generally outwardly projecting self-supporting filament having the ends thereof contactingly secured to said terminal electrode means, said arc-quenching means includes an insulating solid mass disposed to contactingly encapsulate at least the interior ends of said terminal electrode means and the end portions of the fuse element attached thereto, at least a portion of said appearance modifying means being adheringly supported on at least a portion of said fuse element external to said arc-quenching means, and the central apex portion of said element extends beyond said solid mass to be separated at a distance therefrom.

29. The fuse of claim 17 wherein said fuse further includes a quantity of solid arc-quenching means surrounding the ends of said fuse element between a hottest-running portion thereof and said terminal attachment means, said fuse element is configured as a generally outwardly projecting self-supporting filament having the ends thereof contactingly secured to said terminal electrode means, said arc-quenching means includes an insulating solid mass disposed to contactingly encapsulate at least the interior ends of said terminal electrode means and the ends portions of the fuse element attached thereto, at least a portion of said appearance modifying means being adheringly supported on the surface of said solid mass immediately proximate to the points of emergence of said fuse element therefrom, and the central apex portion of said element extends beyond said solid mass to be separated at a distance therefrom.

30. The fuse of claim 17 wherein said fuse element is configured as a generally outwardly projecting self-supporting filament having the ends thereof contactingly secured to said terminal electrode means and having a central apex portion thereof extending into the interior of said housing and away from said terminal electrode means, said fuse further including a quantity of solid arc-quenching means including an insulating solid mass disposed to contactingly encapsulate at least the interior ends of said terminal electrode means and the end portions of the fuse element attached thereto, said insulating solid mass completely covering the interior portions of said terminal electrode means and end portions of said fuse element to present a single continuous surface confronting said central apex portion at a distance therefrom, the central apex portion of said element extending beyond said solid mass to be separated at a distance therefrom, said appearance modifying means is in powder form supported on at least a portion of said fuse element external to said arc-quenching means, and said housing includes an insulated base through which said terminal electrode means extend as a parallel pair and a transparent cover sealingly affixed to said base portion.

31. The fuse of claim 17 wherein said fuse element is configured as a generally outwardly projecting self-supporting filament having the ends thereof contactingly secured to said terminal electrode means and having a central apex portion thereof extending into the interior of said housing and away from said terminal electrode means, said fuse further including a quantity of solid arc-quenching means including an insulating solid mass disposed to contactingly encapsulate at least the interior means of said terminal electrode means and the end portions of the fuse element attached thereto, said insulating solid mass completely covering the interior portions of said terminal electrode means and said end portions of said fuse element to present a single continuous surface confronting said central apex portion at a distance therefrom, the central apex portion of said element extending beyond said solid mass to be separated at a distance therefrom, said appearance modifying means is in powder form adheringly supported to said single continuous surface so as to be exposed to the arc propagating upon fuse blowout from said apex portion to said arc-quenching means, at least a portion of said appearance modifying means is adheringly supported on the surface of said solid mass immediately proximate to the points of emergence of said fuse element therefrom, and the central apex portion of said element extends beyond said solid mass to be separated at a distance therefrom.

* * * * *